US005355812A

United States Patent [19]

Kilpatrick et al.

[11] Patent Number: 5,355,812

[45] Date of Patent: Oct. 18, 1994

[54] PAPERBOARD PALLET WITH DECKING SHEET FOLDED TO FORM OUTER STRINGERS

[75] Inventors: Ted D. Kilpatrick, Ponte Vedra Beach, Fla.; Arthur M. Wagner, Geneva, Ill.

[73] Assignee: Gate Pallet Systems, Inc., Crown Point, Ind.

[21] Appl. No.: 119,726

[22] Filed: Sep. 10, 1993

Related U.S. Application Data

[63] Continuation-in-part of Ser. No. 74,942, Jun. 10, 1993.

[51] Int. Cl.[5] ..... B65D 19/00

[52] U.S. Cl. ..... 108/51.3

[58] Field of Search ..... 108/51.3, 51.1, 56.1, 108/56.3

[56] References Cited

U.S. PATENT DOCUMENTS

| | | | |
|---|---|---|---|
| 2,444,183 | 6/1948 | Cahners | 248/120 |
| 2,446,914 | 8/1948 | Fallert et al. | 108/51.3 |
| 2,506,346 | 5/1950 | Crawford | 248/120 |
| 3,434,435 | 3/1969 | Achermann et al. | 108/56 |
| 3,464,371 | 9/1969 | Gifford | 108/57 |
| 3,659,534 | 5/1972 | Childs | 108/56 |
| 4,303,020 | 12/1981 | Houle | 108/51.3 |
| 4,759,295 | 7/1988 | Nilsen et al. | 108/51.3 |
| 4,792,325 | 12/1988 | Schmidtke | 493/334 |
| 4,864,940 | 9/1989 | Dunn | 108/51.3 |
| 4,867,074 | 9/1989 | Quasnick | 108/51.3 |
| 4,936,229 | 6/1990 | Parnell | 108/51.3 |
| 5,001,991 | 3/1991 | Smith | 108/51.3 |
| 5,129,329 | 7/1992 | Clasen | 108/51.3 |

*Primary Examiner*—José V. Chen

*Attorney, Agent, or Firm*—Dressler, Goldsmith, Shore & Milnamow, Ltd.

[57] ABSTRACT

A pallet made predominantly of corrugated paperboard comprises a first decking sheet defining a first deck and a second decking sheet defining a second deck. The first and second decks are planar. The first decking sheet is folded to form two outer stringers extending longitudinally. Each outer stringer has a box-like profile, which is defined by an outer panel extending vertically from the first deck, a panel extending inwardly from the outer panel and secured adhesively to the second deck, an inner panel extending vertically from the inwardly extending panel, a panel extending outwardly from the inner panel, a panel extending vertically from the outwardly extending panel and secured adhesively to the outer panel, a diagonal panel extending diagonally from the vertically extending panel secured adhesively to the outer panel and bracing the box-like profile, and a panel extending outwardly from the diagonal panel and secured adhesively to the outwardly extending panel that is secured adhesively to the first deck. A middle stringer is interposed between the outer stringers, and between the first and second decks, and is secured adhesively to the first and second decks. Two transverse braces are interengaged with the middle stringer via interengaging notches in the transverse braces and in the middle stringer. The transverse braces are secured adhesively to the middle stringer and to the first and second decks. Each transverse brace has two opposite ends spaced respectively from the outer stringers.

18 Claims, 1 Drawing Sheet

PAPERBOARD PALLET WITH DECKING SHEET FOLDED TO FORM OUTER STRINGERS

CROSS-REFERENCE TO RELATED APPLICATION

This application is a continuation-in-part of U.S. patent application Ser. No. 08/074,942 filed Jun. 10, 1993, and assigned commonly herewith.

TECHNICAL FIELD OF THE INVENTION

This invention pertains to a pallet made predominantly of paperboard material, such as corrugated paperboard. This invention contemplates that the pallet has a decking sheet, which defines a planar deck, and which is folded to form two outer stringers. This invention further contemplates that each outer stringer has a box-like profile defined by adhesively secured panels including a diagonal panel bracing the box-like profile.

BACKGROUND OF THE INVENTION

Usage of shipping pallets made predominantly of corrugated paperboard material is widespread, primarily because of their low cost, recyclability, and cleanliness. Typically, such pallets employ longitudinally extending, transversely spaced stringers, which are made from folded pieces of corrugated paperboard. Such pallets also may employ transversely extending, longitudinally spaced decking members, which also are made from folded pieces of corrugated paperboard. Further, it is known to provide such pallets with upper and lower sheets, which are secured adhesively to the upper and lower edges of the stringers.

As described above, shipping pallets made predominantly of paperboard material, such as corrugated paperboard, are exemplified in Schmidtke U.S. Pat. No. 4,792,325, Quasnick U.S. Pat. No. 4,867,074, and Smith U.S. Pat. No. 5,001,991. Similar pallets made predominantly of corrugated paperboard are available commercially from Gate Pallet Systems, Inc. of Crown Point, Ind. under its PAYLOAD trademark.

Other pallets of related interest are disclosed in Fallert et al. U.S. Pat. No. 2,446,914 and Gifford U.S. Pat. No. 3,464,371. The pallets disclosed therein have paperboard sheets folded to form channels having rectangular profiles. The channels are filled with stacked layers of paperboard to form outer stringers.

SUMMARY OF THE INVENTION

This invention provided an improved pallet, which is made predominantly of corrugated paperboard, such as corrugated paperboard.

Broadly, the improved pallet comprises a decking sheet, which defines a planar deck and which is folded to form two outer stringers extending longitudinally along opposite sides of the pallet. Each outer stringer has panels that define a box-like profile and that include an outer panel extending vertically from the first deck, an outer panel extending vertically from the outer panel, a panel extending inwardly from the outer panel, an inner panel extending vertically from the inwardly extending panel, a panel extending outwardly from the inner panel and secured adhesively to the first deck, and a diagonal panel bracing the box-like profile of such outer stringer.

Preferably, the panels that define the box-like profile of each outer stringer further include a panel extending vertically from the outwardly extending panel and secured adhesively to the outer panel with the diagonal panel extending diagonally from the vertically extending panel secured adhesively to the outer panel. Preferably, moreover, the panels that define the box-like profile of each outer stringer further include a panel extending from the diagonal panel and secured adhesively to another of the panels. Desirably, if such a panel extends from the diagonal panel, it extends outwardly therefrom and is secured adhesively to the outwardly extending panel that is secured adhesively to the deck.

In a preferred embodiment, the improved pallet comprises two decking sheets defining planar decks, namely a first decking sheet defining a first deck and a second decking sheet defining a second deck spaced from and parallel to the first deck. In the preferred embodiment, the first decking sheet is folded to form the outer stringers, each of which has the panels noted above.

These and other objects, features, and advantages of this invention are evident from the following description of a preferred embodiment of this invention with reference to the accompanying drawings.

DETAILED DESCRIPTION OF PREFERRED EMBODIMENT

Figure 1:
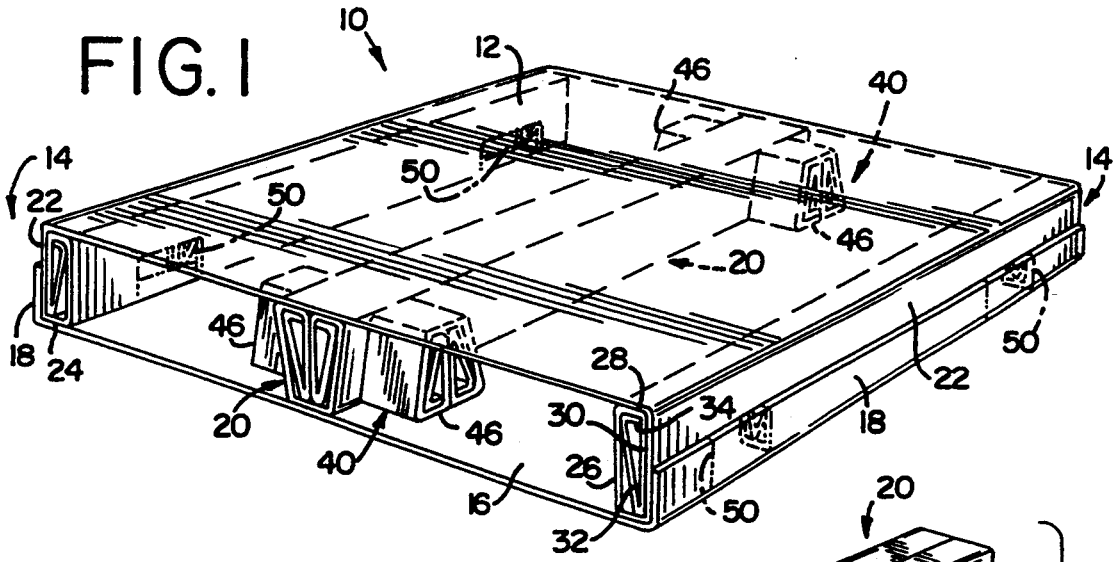
FIG. 1 is a perspective view of a pallet made predominantly of corrugated paperboard and embodying this invention.
Figure 2:
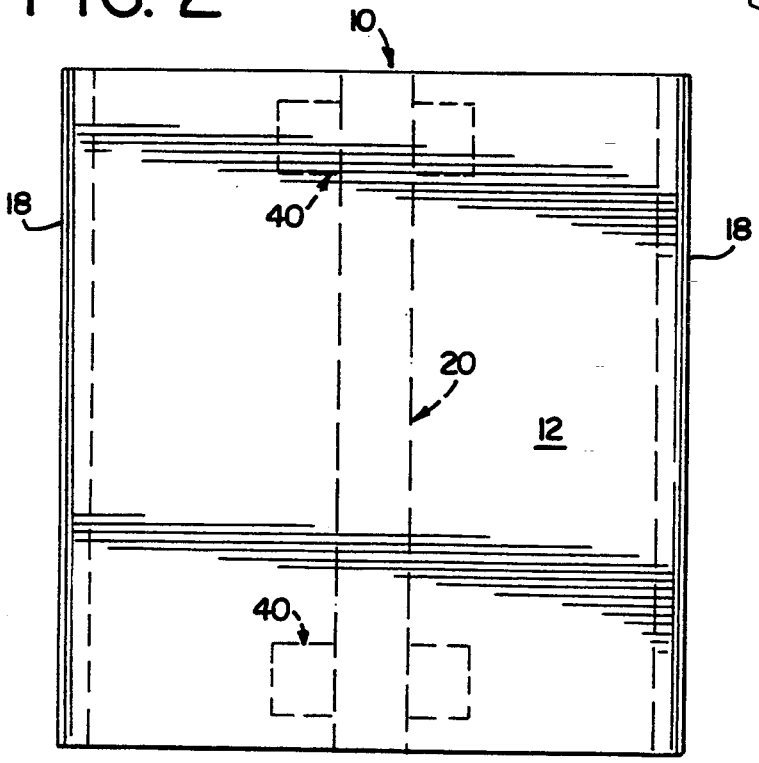
FIG. 2 is a plan view of the pallet shown in FIG. 1.

As shown in FIGS. 1 and 2, a pallet 10 made predominantly from corrugated paperboard constitutes a preferred embodiment of this invention. A first sheet of corrugated paperboard defines a first or upper deck 12, which is planar, and is folded to form two outer stringers 14, which extend from the first or upper deck 12. The outer stringers 14 extend longitudinally along opposite sides of the pallet 10. A second sheet of corrugated paperboard defines a second or lower deck 16, which is planar and parallel to the first or upper deck 12, and is folded to form two side flaps 18, which extend from the second or lower deck 18. The side flaps 18 extend longitudinally along opposite sides of the pallet 10. A third sheet of corrugated paperboard is folded to form a middle stringer 20, which is interposed between the outer stringers 14, and between the respective decks 12, 16, and which is secured adhesively to the respective decks 12, 16.

Each outer stringer 14 has panels that define a rectangular, box-like profile, namely an outer panel 22 extending vertically from the first or upper deck 12, a panel 24 extending inwardly from the outer panel 22, an inner panel 26 extending vertically from the inwardly extending panel 24, a panel 28 extending outwardly from the inner panel 26, a panel 30 extending vertically from the outwardly extending panel 28, a diagonal panel 32 extending diagonally from the vertically extending panel 30 and bracing the box-like profile, and a panel 34 extending outwardly from the diagonal panel 32. As shown, when viewed endwise, the outer stringers 14 are mirror images of each other.

The inwardly extending panel 24 of each outer stringer 14 is secured adhesively to the second or lower deck 18. The outwardly extending panel 28 of each outer stringer 14 is secured adhesively to the first or upper deck 12. The vertically extending panel 30 of each outer stringer 14 is secured adhesively to the outer panel 22 of such outer stringer 14. The outwardly extending panel 34 of each outer stringer 14 is secured adhesively to the outwardly extending panel 28 of such outer stringer 14. Each side flap 18 of the second sheet, which defines the second or lower deck 16, is secured adhesively to the outer panel 22 of one of the outer stringers 14.

Preferably, as shown, the middle stringer 20 has a trapezoidal profile and conforms to the pallet stringer illustrated and described in U.S. patent application Ser. No. 08/038,001 filed Mar. 29, 1993, and assigned commonly herewith. The disclosure of U.S. patent application Ser. No. 08/038,001 is incorporated herein by reference. Alternatively, however, the middle stringer 20 has a trapezoidal profile and conforms to the pallet stringer illustrated and described in Quasnick U.S. Pat. No. 4,867,074, the disclosure of which is incorporated herein by reference. Whichever the middle stringer 20 conforms to, the middle stringer 20 has various panels, certain of which are secured adhesively to other panels of the middle stringer 20 and which include two upper, coplanar panels 36 secured adhesively to the first or upper deck 12 and a lower panel 38 secured adhesively to the second or lower deck 16.

Two transverse braces 40 are employed, each being cut from a stringer similar to the middle stringer 20 so as to have a similar, trapezoidal profile, and each being inverted as compared to the middle stringer 20. Each transverse brace 40 is interengaged with the middle stringer 20 in a manner illustrated and described in U.S. patent application Ser. No. 08/074,942, supra, the disclosure of which is incorporated herein by reference.

Figure 3:
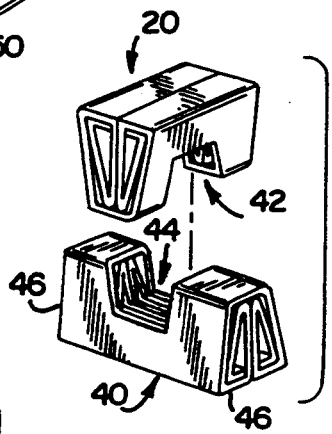
FIG. 3 is a fragmentary, exploded view, which exemplifies how a notch in a transverse brace interengages with a notch in a middle stringer, in the pallet shown in FIGS. 1 and 2.

Thus, the middle stringer 20 has two notches 42, each of which opens downwardly and is associated with one of the transverse braces 40. Also, each transverse brace 40 has a notch 44 that opens upwardly and is interengaged with the associated notch 42 of the middle stringer 20, as shown in FIG. 3. The transverse braces 40 are secured adhesively to the middle stringer 20, at the interengaging notches 42, 44. Moreover, each transverse brace 40 has two opposite ends 46, which are spaced respectively from the outer stringers 14. Being cut from a stringer similar to the middle stringer 20, each transverse brace 40 has various panels, certain of which are secured adhesively to other panels of such transverse brace 40, and which include two lower, coplanar panels 46 secured adhesively to the second or lower deck 16 and an upper panel 48 secured adhesively to the first or upper deck 12.

As shown in broken lines in FIG. 1, two pairs of transversely aligned slots 50 may be optionally provided through the outer stringers 14 and the side flaps 18, near the second or lower deck 16, along with transversely aligned slots (not shown) in the middle stringer 20. The side flaps 18 may be cut away at the slots 50. If the transverse braces 40 are spaced widely from each other as in FIG. 1, it may be necessary to relocate the transverse braces 40 closer to each other so as to permit such aligned slots to be provided in the middle stringer 20, and so as to accommodate a pair of fork lift blades (not shown) without interference with the transverse braces 40.

Herein, directional terms such as "upper" and "lower" refer to the pallet 10 in a preferred orientation, in which the pallet 10 is shown. The pallet 10 would be also useful in an inverted orientation, except that it would be then preferable for the pallet 10 to have slots (not shown) similar to the aforenoted slots but provided near the deck 12, rather than near the deck 16.

Preferably, each of the three sheets noted above is folded from a single sheet of double wall, corrugated paperboard, which may be tape-reinforced or fiber-reinforced. Single wall, corrugated paperboard or multi-ply paper may be alternatively used. Preferably, each of the three sheets noted above is folded along parallel folding lines extending in a transverse direction relative to flutes of the single sheet of corrugated paperboard.

Where adhesive securement is specified above, a so-called "cold melt" or "cold set" adhesive is suitable, such as Code No. 3715 or Code No. 3715B, both of which are available commercially from H. B. Fuller Co. of Palatine, Ill.

As illustrated and described herein, the pallet 10 may be advantageously used in an application requiring a narrow pallet but employing a fork lift having widely spaced blades, which may need to enter the pallet longitudinally. Thus, if the pallet 10 has a transverse dimension of about thirty inches and if each outer stringer 14 has a transverse width of about one and one half inches, fork lift blades spaced by nearly twenty seven inches at their outer edges can enter the pallet 10 longitudinally for lifting and moving the pallet 10 without damaging the pallet 10.

Various modifications may be made in the preferred embodiment described above without departing from the scope and spirit of this invention.

We claim:

1. A pallet made predominantly of corrugated paperboard, the pallet comprising a first decking sheet defining a first deck and a second decking sheet defining a second deck spaced from and parallel to the first deck, the first and second decks being planar, the first decking sheet being folded to form two outer stringers extending longitudinally along opposite sides of the pallet, each outer stringer having panels that define a box-like profile with two upper corners and two lower corners and that include an outer panel extending vertically from the first deck, a panel extending inwardly from the outer panel and secured adhesively to the second deck, an inner panel extending vertically from the inwardly extending panel, a panel extending outwardly from the inner panel and secured adhesively to the first deck, and a diagonal panel extending from another of the panels of such outer stringer and extending diagonally from one of the upper corners of such outer stringer to one of the lower corners of such outer stringer, so as to brace the box-like profile of such outer stringer, wherein the outer stringers are spaced from each other and wherein spacing between the outer stringers is at least several times greater than spacing between the outer and inner panels of either of the outer stringers.

2. The pallet of claim 1 wherein the panels defining the box-like profile of each outer stringer further include a panel extending vertically from the outwardly extending panel and secured adhesively to the outer panel with the diagonal panel extending diagonally from the vertically extending panel secured adhesively to the outer panel.

3. The pallet of claim 2 wherein the panels defining the box-like profile of each outer stringer further include a panel extending from the diagonal panel and secured adhesively to another of the panels.

4. The pallet of claim 2 wherein the panels defining the box-like profile of each outer stringer further include a panel extending outwardly from the diagonal panel and secured adhesively to the outwardly extending panel that is secured adhesively to the first deck.

5. The pallet of claim 1, 2, 3, or 4 wherein the second decking sheet is folded to form two outer flaps extending from the second deck, the outer flaps extending along opposite sides of the pallet, each outer flap being secured adhesively to the outer panel of one of the outer stringers.

6. The pallet of claim 5 wherein the outer flaps partly cover the outer panels of the outer stringers.

7. The pallet of claim 1 further comprising a middle stringer interposed between and spaced from each of the outer stringers, and between the first and second decks, and secured adhesively to the first and second decks.

8. A pallet made predominantly of corrugated paperboard, such as corrugated paperboard, the pallet comprising a first decking sheet defining a first deck and a second decking sheet defining a second deck spaced from and parallel to the first deck, the first and second decks being planar, the first decking sheet being folded to form two outer stringers extending longitudinally along opposite sides of the pallet, each outer stringer having panels that define a box-like profile with two upper corners and two lower corners and that include an outer panel extending vertically from the first deck, a panel extending inwardly from the outer panel and secured adhesively to the second deck, an inner panel extending vertically from the inwardly extending panel, a panel extending outwardly from the inner panel and secured adhesively to the first deck, and a diagonal panel bracing the box-like profile of such outer stringer, the pallet further comprising a middle stringer interposed between the outer stringers, and between the first and second decks, and secured adhesively to the first and second decks, the pallet further comprising a transverse brace interengaged with the middle stringer via interengaging notches in the transverse brace and in the middle stringer, the transverse brace being secured adhesively to the middle stringer and to the first and second decks.

9. The pallet of claim 8 wherein the transverse brace has two opposite ends spaced respectively from the outer stringers.

10. The pallet of claim 8 wherein the transverse brace is one of two transverse braces interengaged with the middle stringer via interengaging notches in the transverse braces and in the middle stringer, the transverse braces being secured adhesively to the middle stringer and to the first and second decks.

11. The pallet of claim 10 wherein each transverse brace has two opposite ends spaced respectively from the outer stringers.

12. A pallet made predominantly of paperboard, such as corrugated paperboard, the pallet comprising a decking sheet defining a planar deck and folded to form two outer stringers extending longitudinally along opposite sides of the pallet, each outer stringer having panels that define a box-like profile with two upper corners and two lower corners and that include an outer panel extending vertically from the first deck, a panel extending inwardly from the outer panel, an inner panel extending vertically from the inwardly extending panel, a panel extending outwardly from the inner panel and secured adhesively to the first deck, and a diagonal panel extending from another of the panels of such outer stringer and extending diagonally from one of the upper corners of such outer stringer to one of the lower corners of such outer stringer, so as to brace the box-like profile of such outer stringer, wherein the outer stringers are spaced from each other and wherein spacing between the outer stringers is at least several times greater than spacing between the outer and inner panels of either of the outer stringers.

13. The pallet of claim 12 wherein the panels defining the box-like profile of each outer stringer further include a panel extending vertically from the outwardly extending panel and secured adhesively to the outer panel with the diagonal panel extending diagonally from the vertically extending panel secured adhesively to the outer panel.

14. The pallet of claim 13 wherein the panels defining the box-like profile of each outer stringer further include a panel extending from the diagonal panel and secured adhesively to another of the panels.

15. The pallet of claim 13 wherein the panels defining the box-like profile of each outer stringer further include a panel extending outwardly from the diagonal panel and secured adhesively to the outwardly extending panel that is secured adhesively to the deck.

16. The pallet of claim 12 wherein each outer stringer has a transverse width and wherein the pallet has a transverse width, which is at least several times greater than the combined, transverse widths of the outer stringers.

17. The pallet of claim 16 wherein the transverse width of the pallet is about twenty times the transverse width of each outer stringer.

18. The pallet of claim 17 wherein each outer stringer has a transverse width of about one and one half inches and wherein the pallet has a transverse width of about thirty inches.

* * * * *